US010000222B2

(12) United States Patent
Allshouse et al.

(10) Patent No.: US 10,000,222 B2
(45) Date of Patent: Jun. 19, 2018

(54) METHODS AND SYSTEMS OF DETERMINING END OF TRAIN LOCATION AND CLEARANCE OF TRACKSIDE POINTS OF INTEREST

(71) Applicant: LOCKHEED MARTIN CORPORATION, Bethesda, MD (US)

(72) Inventors: Richard A. Allshouse, Manassas, VA (US); Charles W. Morris, Nokesville, VA (US); Joseph E. Sanfilippo, Chadds Ford, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 145 days.

(21) Appl. No.: 14/825,595

(22) Filed: Aug. 13, 2015

(65) Prior Publication Data

US 2017/0043797 A1 Feb. 16, 2017

(51) Int. Cl.

| | |
|---|---|
| ***B61L 25/02*** | (2006.01) |
| ***B61L 1/14*** | (2006.01) |
| ***B61L 3/12*** | (2006.01) |
| ***B61L 15/00*** | (2006.01) |

(52) U.S. Cl.

CPC ..... *B61L 25/025* (2013.01); *B61L 1/14* (2013.01); *B61L 3/125* (2013.01); *B61L 15/0054* (2013.01); *B61L 15/0072* (2013.01)

(58) Field of Classification Search

CPC .... B61L 15/0054; B61L 15/0072; B61L 1/14; B61L 25/025; B61L 3/125; B61L 15/0027; B61L 2205/04; B61L 17/00; B61L 23/34; B61L 27/0094; B61L 25/028; B61L 27/0005; B61L 25/00; B61L 25/02

See application file for complete search history.

(56) References Cited

U.S. PATENT DOCUMENTS

| | | | | |
|---|---|---|---|---|
| 5,036,478 | A * | 7/1991 | MacDougall | B61L 1/16 246/122 R |
| 6,081,769 | A * | 6/2000 | Curtis | B61L 1/14 246/122 R |
| 8,688,297 | B2 | 4/2014 | Morris | |
| 8,918,237 | B2 | 12/2014 | Morris | |
| 9,174,657 | B2 | 11/2015 | Morris | |
| 2013/0060520 | A1 * | 3/2013 | Amor | G01S 5/0018 702/154 |
| 2014/0263862 | A1 | 9/2014 | Morris | |
| 2015/0060608 | A1 * | 3/2015 | Carlson | B61L 3/125 246/122 R |
| 2016/0016597 | A1 | 1/2016 | Morris | |

OTHER PUBLICATIONS

Information From Inventors on Uses of Rail RFID Tags and Readers, Jun. 18, 2014 (1 page).

* cited by examiner

*Primary Examiner* — Mark T Le

(74) *Attorney, Agent, or Firm* — Hamre, Schumann, Mueller & Larson, P.C.

(57) ABSTRACT

Methods and systems that utilize radio frequency identification (RFID) tags mounted at trackside points of interest (POI) together with an RFID tag reader mounted on an end of train (EOT) car. The RFID tag reader and the RFID tags work together to provide information that can be used in a number of ways including, but not limited to, determining train integrity, determining a geographical location of the EOT car, and determine that the EOT car has cleared the trackside POI along the track.

11 Claims, 7 Drawing Sheets

METHODS AND SYSTEMS OF DETERMINING END OF TRAIN LOCATION AND CLEARANCE OF TRACKSIDE POINTS OF INTEREST

FIELD

This technical disclosure relates to methods and systems of determining the geographical location of an end of train car, determining train integrity, and determining when an end of train car clears a point of interest along the tracks the train is on.

BACKGROUND

Positive train control (PTC) systems are currently under development in the United States and elsewhere. One benefit of a PTC system is to shorten the headways between successive trains on the same track segment, which can permit more traffic routing and traffic flow flexibility in planning and scheduling. In a PTC system, positive knowledge of the location of the end of the train is required since trains must maintain positive length of train awareness. Without end of train knowledge, the use of track occupancy circuits has to be maintained and/or their densities increased to support the current traffic density.

Accurate knowledge of the actual physical location of the rear end of a train is difficult to obtain because trains can vary in length during operation depending on whether the train is traveling on a descending grade, on an ascending grade, or at level grade. The length can vary as a result of the slack in couplers used to couple the cars to one another. Because of this ambiguity in train length, trains are typically managed by assigning each train a "safe train length" 2 which is longer than the actual train length 4 as shown in FIG. 1.

One example of a problem associated with assigning a safe train length 2 is illustrated in FIG. 1. A main railway track 6 may have a sidetrack or siding 8. A train 10 may be traveling on the track 6 in the direction indicated by the arrow. A second train (not shown) may be located on the sidetrack 8 waiting to enter onto the track 6 in the other direction. The second train must wait until an end of train car 12 of the train 10 passes the junction 14 before entering the track 6. With the assigned safe train length 2, the train 10 is assumed to be much longer than it actually is as indicated by the broken lines in FIG. 1. Therefore, the train waiting on the sidetrack 8 must wait until a trailing end $E_s$ of an assumed end of train car 12' passes the junction 14, even though an actual trailing end $E_a$ of the actual end of train car 12 of the train 10 has already passed the junction 14. As a result, entry of the train on the sidetrack 8 onto the track 6 is unnecessarily delayed.

SUMMARY

Methods and systems are described that utilize radio frequency technology between an end of train (EOT) car of a train and stationary features along the track the train is traveling on to directly monitor the presence and the physical location of the EOT car. The systems and methods described herein utilize radio frequency identification (RFID) tags mounted at trackside points of interest (POI) together with an RFID tag reader mounted on the EOT car. The RFID tag reader and the RFID tags work together to provide information that can be used in a number of ways including, but not limited to, determining train integrity, determining a geographical location of the EOT car, and determining that the EOT car has cleared the trackside POI along the track. The RFID systems described herein can also be used to make vital train protection decisions including release authority protection decisions.

As the train is traveling along the tracks and the EOT car passes a trackside POI containing an RFID tag, the RFID tag reader on the EOT car reads data from the RFID tag. The data that is read from the RFID tag can include, but is not limited to, geographical coordinates of the trackside POI and/or a unique feature identifier that uniquely identifies the trackside POI. The geographical coordinates and/or the unique feature identifier read from the RFID tag can then be used to compare with expected geographical coordinates, validate train integrity, and/or determine that the EOT car has cleared the POI. A failure of the EOT car to read data from an RFID tag can indicate a train integrity problem.

A trackside POI as used herein is any structure or feature along a railroad track that the train travels on. Examples of trackside POIs include, but are not limited to, track circuits, tunnels, bridges, level crossings, block limits, wayside posts, track junctions, and the like. The RFID tags described herein are mounted on or near (for example on a crosstie) the trackside POIs. The RFID tags can be mounted at any locations that permit data stored on the tags to be read by the RFID tag reader mounted on the EOT car as the EOT car passes the trackside POIs.

In one embodiment, a method can include using an RFID tag reader mounted on an EOT car of a train to read data from an RFID tag mounted at a trackside POI as the EOT car passes the trackside POI. Data read from the RFID tag is then wirelessly transmitted from the EOT car to a head of train (HOT) car of the train. The data is received at the HOT car, and the location of the EOT car is determined at the HOT car based on the received data.

In another embodiment, a system is provided that monitors the location of an EOT car of a train that includes a HOT car. The system can include an RFID tag reader mounted on the EOT car, a radio frequency transmitter, such as a transceiver, mounted on the EOT car, and a power source mounted on the EOT car and providing power to the RFID tag reader and the radio frequency transmitter. In addition, a radio frequency transceiver is mounted on the HOT car. At least one trackside POI includes an RFID tag associated therewith. The RFID tag is mounted at the trackside POI and the RFID tag includes data stored thereon. The RFID tag is readable by the RFID tag reader mounted on the EOT car as the EOT car passes the trackside POI.

In still another embodiment, an EOT device is provided that is mountable on an EOT car of a train. The EOT device can include an RFID tag reader, a radio frequency transmitter, and a power source providing power to the RFID tag reader and to the radio frequency transmitter. In some embodiments, the EOT device can also include a brake pipe pressure monitor and a marker light, each of which is also powered by the power source.

DRAWINGS

Figure 3:
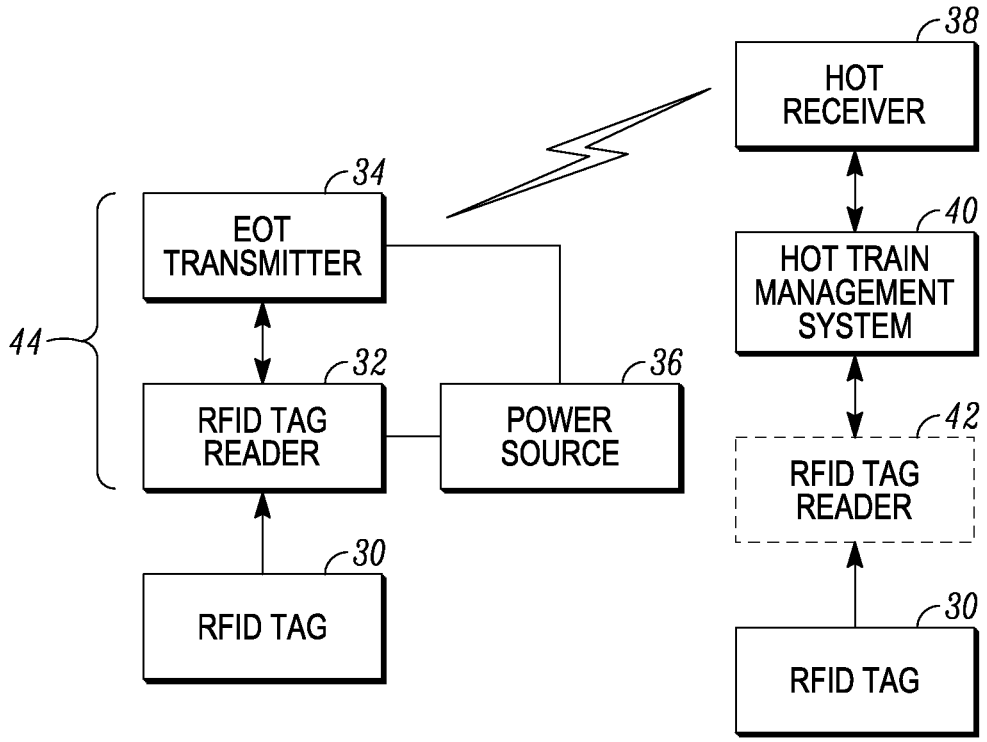

FIG. 3 schematically illustrates one embodiment of a system described herein.

Figure 4:
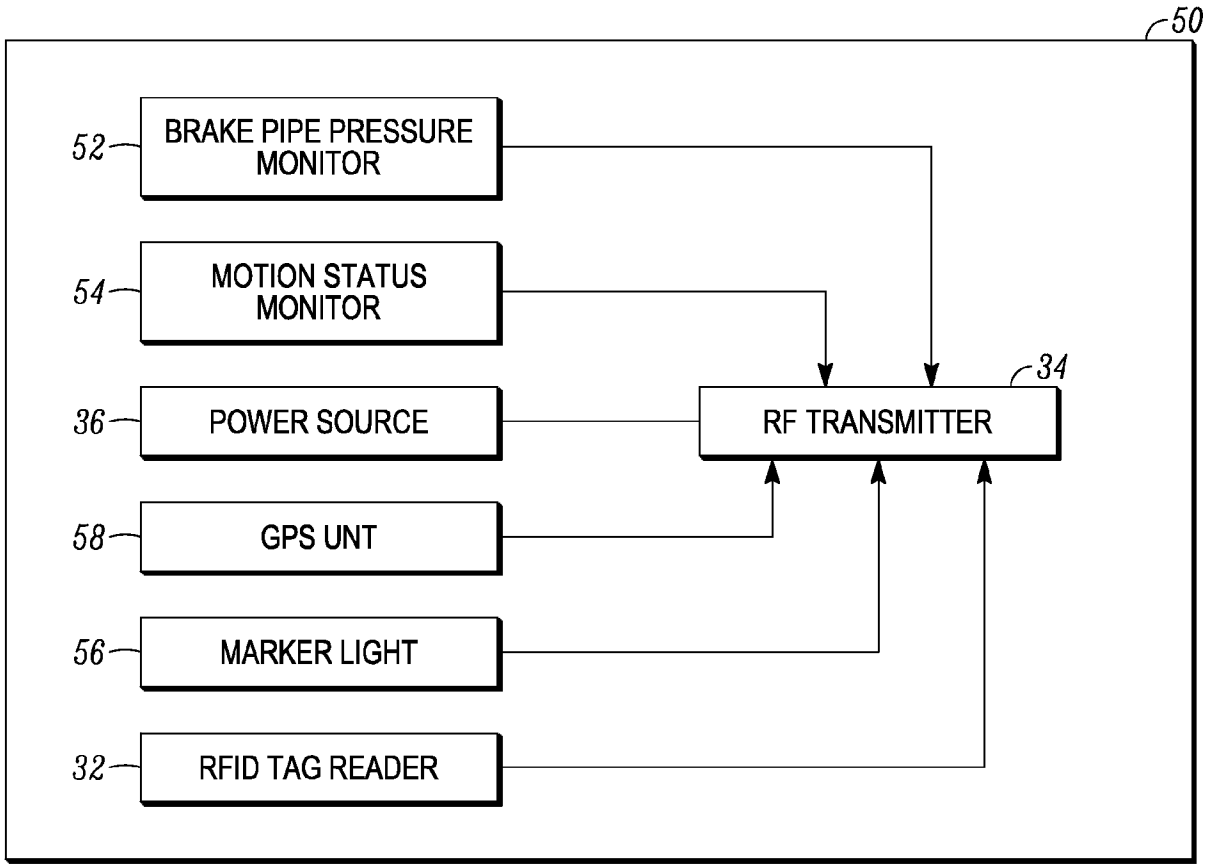

FIG. 4 illustrates one embodiment of an EOT device described herein that can be mounted on the EOT car.

Figure 5:
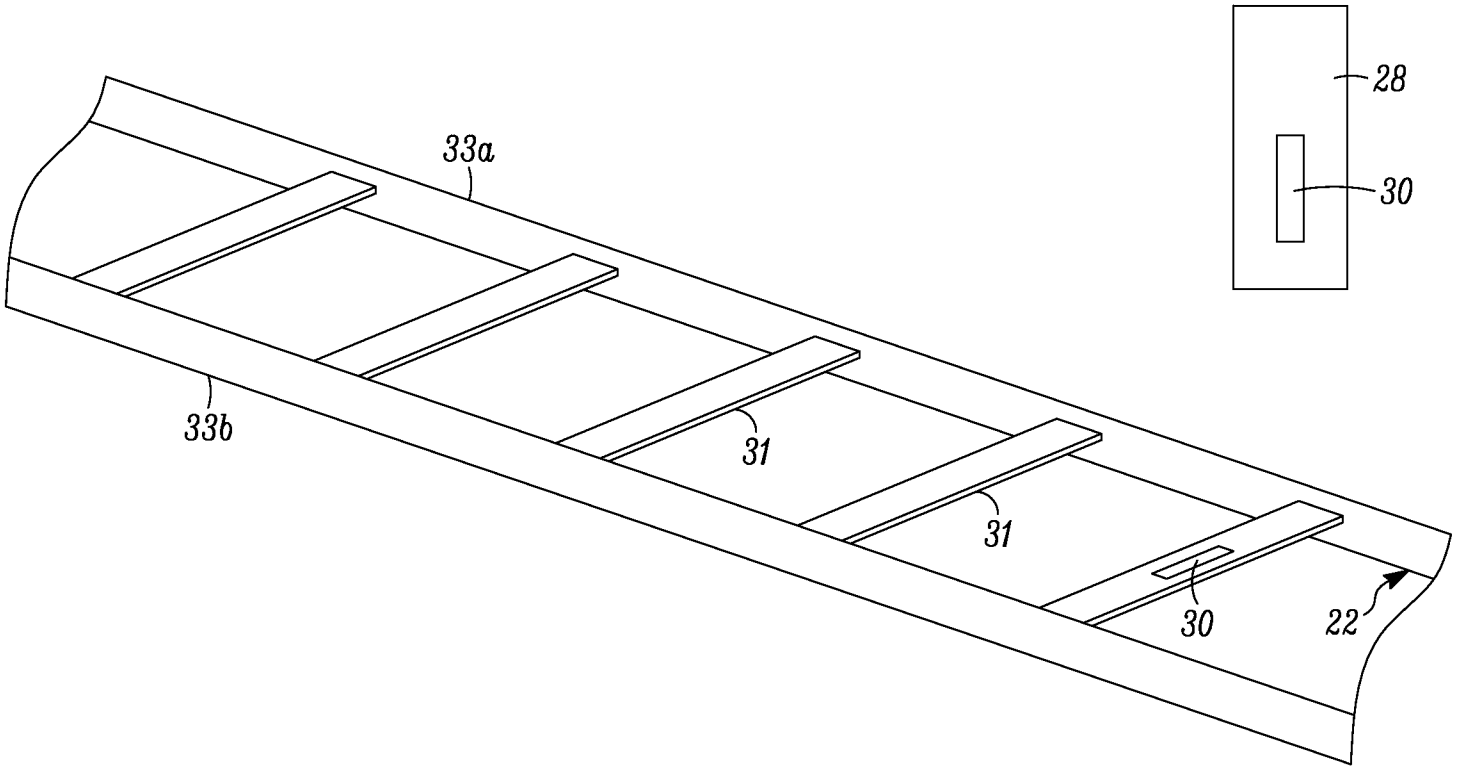

FIG. 5 illustrates a track on which the train can travel, together with a trackside POI and example mounting locations for the RFID tags.

Figure 6:
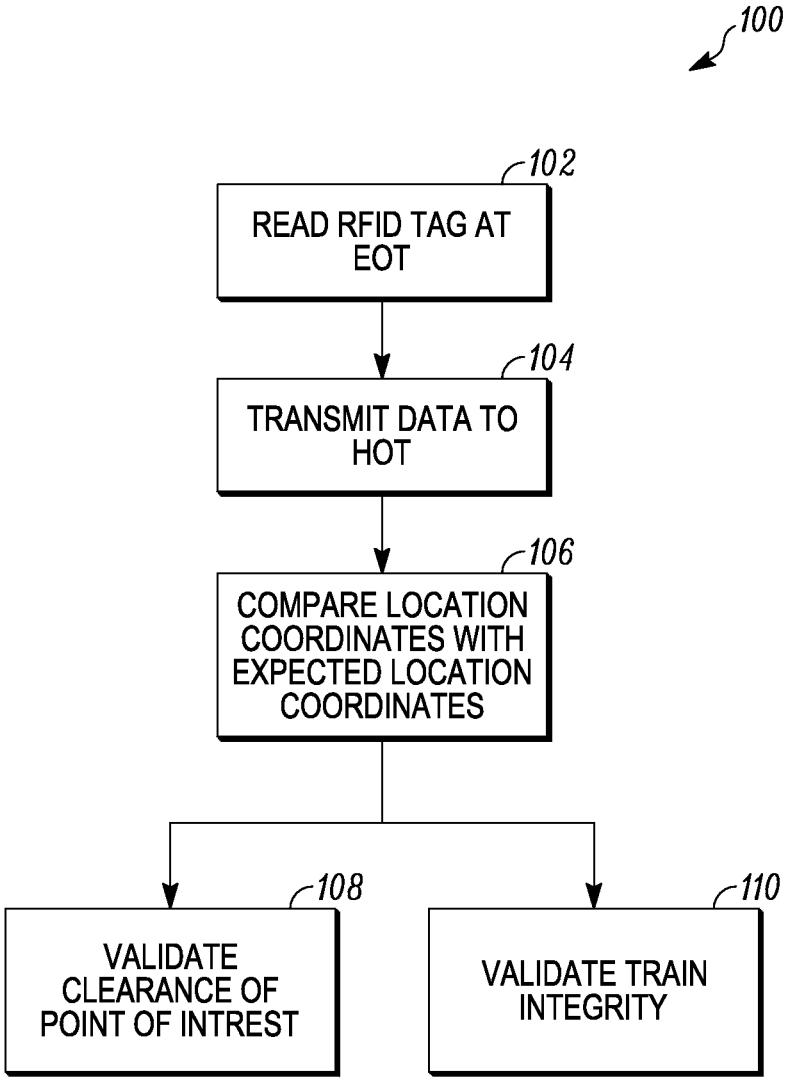

FIG. 6 illustrates one embodiment of a method described herein.

Figure 7:
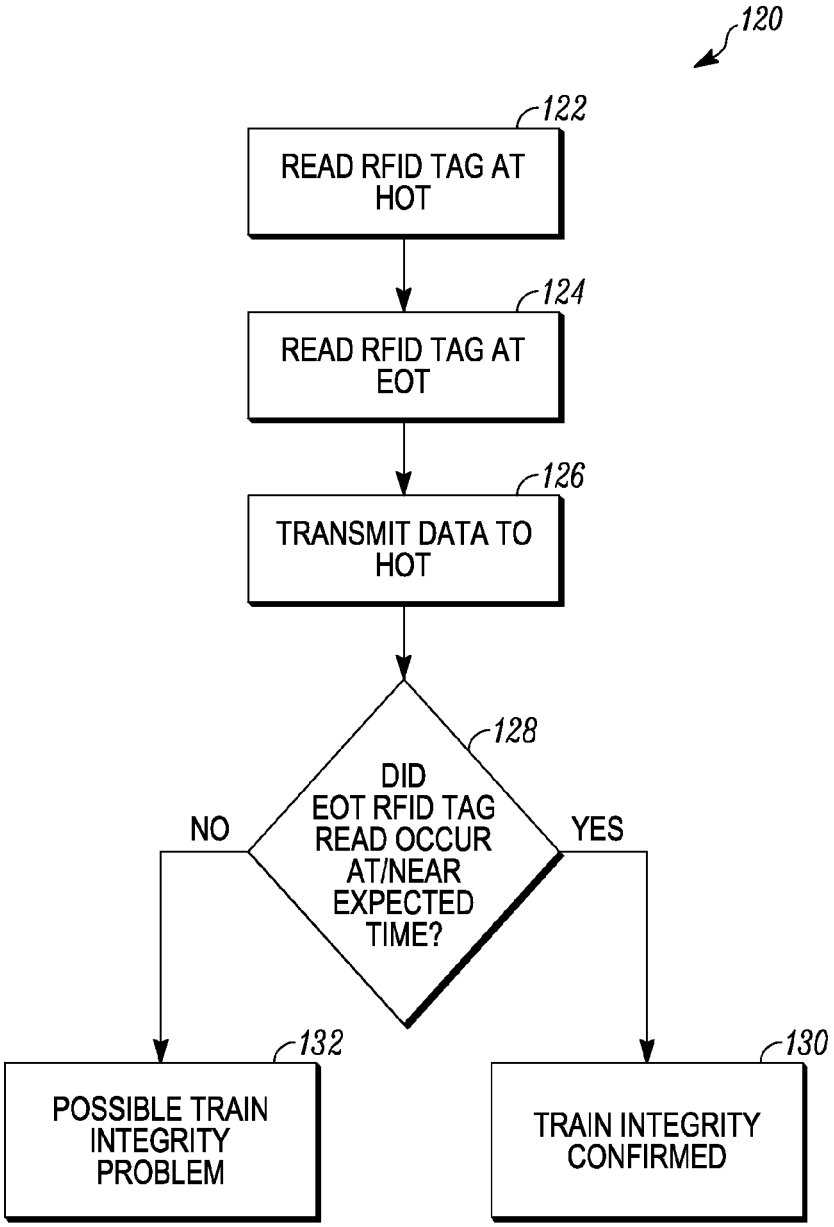

FIG. 7 illustrates another embodiment of a method described herein.

DETAILED DESCRIPTION

A trackside POI as used herein is any structure or feature along a railroad track that the train travels on. Examples of trackside POIs include, but are not limited to, track circuits, tunnels, bridges, level crossings, block limits, wayside posts, track junctions, and the like. When an RFID tag described herein is mounted on the trackside POI, the trackside POI can be located at any distance from the track that allows data from the RFID tag to be read by an RFID tag reader that is mounted on the EOT car (or in some embodiments on the HOT car) as the EOT car passes the trackside POI. In one embodiment, the trackside POI along with the RFID tag are located 2 meters or less from the track on which the train travels.

In some embodiments, the RFID tags described herein can be mounted on the trackside POIs. In other embodiments, the RFID tags described herein can be mounted near to but not directly on the trackside POIs, for example on crossties that are near the POIs. If the RFID tags are not mounted on the trackside POIs, the RFID tags are nonetheless associated with the adjacent trackside POIs so that the data read from the RFID tags provide information about the geographical locations of the POIs and/or provide information to determine whether or not the EOT car has cleared the POIs. In other embodiments, some of the RFID tags described herein can be mounted on trackside POIs while other RFID tags are mounted near, but not directly on, the trackside POIs. Unless otherwise indicated, the language "mounted at" a trackside POI is intended to encompass at least the RFID tag mounted directly on the trackside POI or mounted near to but not directly on the associated trackside POI.

The term "wirelessly transmitting data" used herein means that data is transmitted between two points, such as between the EOT car and the HOT car, using electromagnetic waves rather than transmitting the data through wires or cables.

Figure 1:
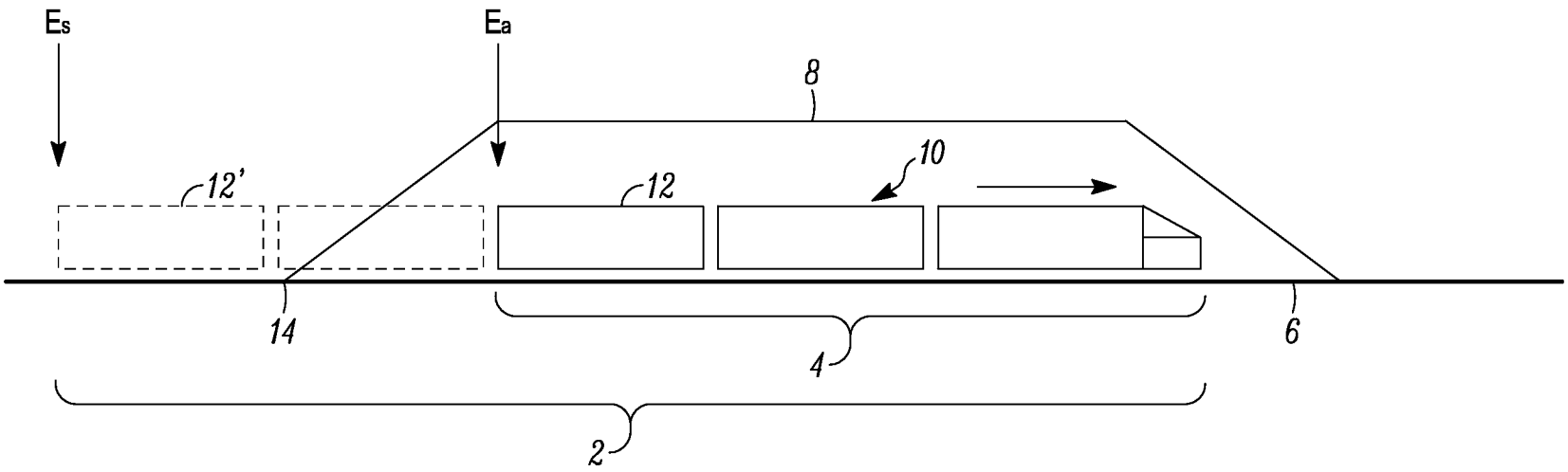
FIG. 1 illustrates a train traveling on a track having a sidetrack to demonstrate the concept of a safe train length.
Figure 2:
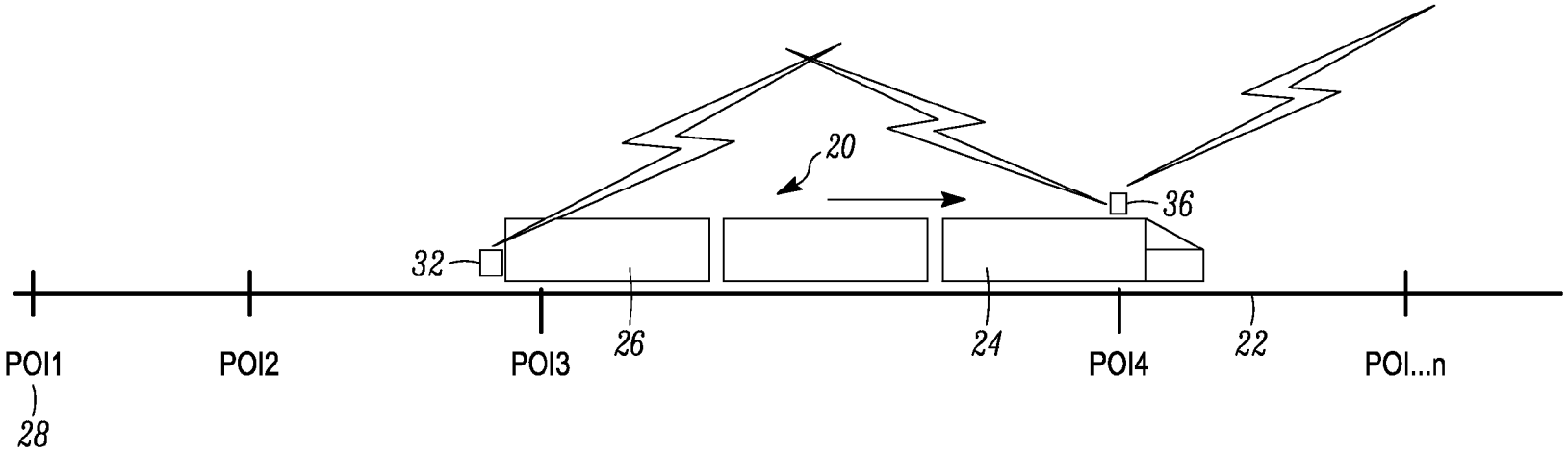
FIG. 2 illustrates a train traveling on a track incorporating the methods and systems described herein.

With reference to FIG. 2, a train 20 is illustrated as traveling in the direction of the arrow along a track 22. The train 20 includes a HOT car 24 and an EOT car 26. The HOT car 24 is the first car of the train 20 and, in one embodiment, is a locomotive or engine. The EOT 26 is the very last car of the train 20. There can be any number of cars between the HOT car 24 and the EOT car 26 with all of the cars being coupled together via couplers. The number of cars between the HOT car 24 and the EOT car 26 can vary. In addition, due to adding and removing cars from the train 20, the car that forms the EOT car 26 can vary. But regardless of the number of cars in the train 20, the last car of the train 20 is considered to EOT car 26.

A plurality of trackside POIs 28 (labeled POI1, POI2, POI3, POI4, POI . . . n) are located along the track 22. Each POI 28 has associated therewith an RFID tag 30 (FIGS. 3 and 5). With reference to FIG. 5, in one embodiment the RFID tag 30 can be mounted directly on the POI 28 which is located next to or along the side of the track 22. In one embodiment, the RFID tag 30 can be mounted substantially vertically on the POI 28 with a longitudinal axis of the RFID tag 30 extending generally vertically. In another embodiment illustrated in FIG. 5, the RFID tag 30 is mounted on a crosstie 31 that extends between and supports rails 33*a*, 33*b* that form the track 22. In this example, the RFID tag 30 can be mounted substantially horizontally on the crosstie 31 with a longitudinal axis thereof extending generally horizontally.

The RFID tags 30 can be passive tags that are configured to utilize energy transmitted from an RFID tag reader for operation. Passive RFID tags typically include an integrated circuit, an antenna, and a non-volatile memory that stores data. In another embodiment, the RFID tags 30 can be active with their own power source on each tag 30.

Each RFID tag 30 includes fixed data that is stored in the non-volatile memory of the RFID tag. The term "fixed data" is intended to refer to data that is typically static and not intended to change during use of the RFID tag while associated with its trackside POI 28. However, the fixed data stored on the RFID tag 30 may be changeable, for example if the RFID tag 30 is reused so that it is later associated with a different trackside POI 28. The fixed data can be any data that can be used to help determine location of the EOT car 26. In one embodiment, the fixed data can be geographical coordinates of the trackside POI 28 or a unique identifier for the trackside POI 28 with which the RFID tag 30 is associated. In another embodiment, the fixed data can be geographical coordinates and a unique identifier for the trackside POI 28 with which the RFID tag 30 is associated.

The geographical coordinates data can be any data representing geographical coordinates of the location of the trackside POI 28. For example, the geographical coordinates data can provide the latitude and longitude of the trackside POI 28. In some embodiment, the geographical coordinate data can also include the elevation of the trackside POI 28. In some embodiments, the geographical coordinates data is not limited to earth centered-based coordinates. Instead, the geographical coordinates data can be data referring to a reference frame that is specific to a track database model, for example of the type described in U.S. Published Application No. 2014/0263862, the entire contents of which are incorporated herein by reference. In still other embodiments, the geographical coordinates data can be data that refers to a general location, such as data indicating the physical track that the RFID tag 30 is supporting (for example track 1, track 2, etc.).

The unique identifier data can be any data that uniquely identifies the trackside POI 28. The unique identifier data can be, for example, a unique serial number of the RFID tag 30 which is associated with the trackside POI 28 in a database, a unique name assigned to the associated trackside POI 28 that is stored in the RFID tag memory prior to use, and the like. The unique identifier can be formed by any combination of letters, numbers and symbols.

Referring to FIGS. 2 and 3, the EOT car 26 includes an RFID tag reader 32 mounted at the rear end thereof that reads data from the RFID tag 30 as the EOT car 26 passes the trackside POI 28. As the EOT car 26 passes the trackside POI 28, the RFID tag reader 32 transmits interrogator signals toward the RFID tag 30, and in reply the RFID tag 30 sends data which is received by the RFID tag reader 32. In one embodiment, the RFID tag reader 32 can continuously send out interrogator signals as the train is in motion. In another embodiment, the sending of the interrogation signals by the RFID tag reader 32 can be controlled, for example based on commands from the HOT car 24 as the HOT car 24 passes by the RFID tag 30. This will permit a reduction in power use since the RFID tag reader 32 can be turned on only when the train 20 is passing a POI 28 that needs to be detected. The function and operation of RFID tags and RFID tag readers is well known to persons of ordinary skill in the art.

In one embodiment, the RFID tag reader 32 can have a relatively wide vertical field of view and a narrower horizontal field of view which is beneficial for reading the RFID tags 30 mounted vertically on the POIs. However, the RFID tag reader 32 can have other field of view configurations.

The RFID tags 30 and RFID tag reader 32 described herein can have any configuration suitable for achieving the functions described herein. One example of suitable RFID tags are RFID tags used in the Automatic Equipment Identification (AEI) electronic recognition system used with the North American railroad industry available from Transcore of Nashville, Tenn. One example of a suitable RFID tag reader is the multiprotocol rail reader (MPRR) available from Transcore of Nashville, Tenn.

Data that is read by the RFID tag reader 32 is wirelessly transmitted to the HOT car 24 by a suitable wireless transmitter 34, such as a radio frequency transmitter if only data transmitting functions are required or a radio frequency transceiver if transmit and receive functions are required. Power for powering operation of the RFID tag reader 32 and the transmitter 34 is provided by a power source 36, for example one or more rechargeable batteries.

The HOT car 24 includes a suitable wireless receiver 38 that receives the signals transmitted by the transmitter 34. The wireless receiver 38 can be a radio frequency receiver if only a data receive function is required or a radio frequency transceiver if transmit and receive functions are required. In one embodiment, the HOT car 24 can communicate with a dispatch center (not shown) or other location directly or indirectly via wireless communication techniques or a combination of wireless and wired communication techniques, using the receiver 38 or using a separate transmitting device, as illustrated in FIG. 2.

With reference to FIG. 3, data received by the HOT receiver 38 from the EOT transmitter 34 is forwarded to a HOT train management system 40 that includes a data processor. The HOT train management system 40 uses the data received from the EOT transmitter 34 to derive information concerning the location of the EOT car 26.

In some embodiments, the HOT car 24 may optionally include an RFID tag reader 42 as illustrated in FIG. 3. The RFID tag reader 42 can have a configuration similar to the RFID tag reader 32 on the EOT car 26. When the RFID tag reader 42 is present, the tag reader 42 can be used to read data from the RFID tag 30 as the HOT car 24 passes the trackside POI 28. As will be discussed further below, the reading of the data by the RFID tag reader 42 can be used, together with the reading of the data by the RFID tag reader 32 on the EOT car 26, to confirm the integrity of the train, i.e. confirm that cars have not separated from the train. In some embodiments, the RFID tag reader 42 on the HOT car 24 can be used independently of the RFID tag reader 32 on the EOT car 26, for example when precise HOT car 24 location information is needed.

As shown in FIG. 3, the RFID tag reader 32, the transmitter 34, and the power source 36 can be physically separate from one another, but connected to one another in a manner to permit data that is read by the RFID tag reader 32 to be received by the EOT transmitter 34. In another embodiment, the RFID tag reader 32, the EOT transmitter 34, and the power source 36 can be individual components of a single common unit 44 that is removably mountable at the rear end of the EOT car 26.

In another embodiment illustrated in FIG. 4, the RFID tag reader 32 and the EOT transmitter 34 are part of an end of train device 50 that is removably mountable on the rear end of the EOT car 26. The end of train device 50 can optionally include other components that are common to end of train devices including, but not limited to, one or more of a brake pipe pressure monitor 52, a motion status monitor 54 that monitors motion of the EOT car 26, a marker light 56, and a Global Positioning System (GPS) unit 58. The RFID tag reader 32, the EOT transmitter 34, the brake pipe pressure monitor 52, the motion status monitor 54, the marker light 56, and the GPS unit 58 are all powered by the power source 36. In addition, data from each of the RFID tag reader 32, the brake pipe pressure monitor 52, the motion status monitor 54, the marker light 56, and the GPS unit 58 can be provided to the EOT transmitter 34 to send data regarding each to the HOT car 24.

The use of the RFID tags 30 and the RFID tag reader 32 on the EOT car 26 provides monitoring of the presence of the EOT car 26 and knowledge of the physical location of the EOT car 26. For example, reading of the RFID tag 30 by the RFID tag reader 32 can provide the following information among others:

a) Knowledge of the location of the EOT car 26 based on either or both of the geographical coordinates and the unique identifier being read from the RFID tag 30. If the data read from the RFID tag 30 is the geographical coordinates of the trackside POI 28, the geographical coordinate data will indicate the general location of the EOT 26 car since the EOT car 26 is near the POI 28. If the data read from the RFID tag 30 is the unique identifier, the unique identifier can be used by the HOT train management system 40 to look up the geographical coordinates corresponding to that POI 28, which coordinates indicate the general location of the EOT 26 car since the EOT car 26 is near the POI 28.

b) Knowledge of when the EOT car 26 clears the trackside POI 28. In order for the RFID tag reader 32 to read the RFID tag 30, the end of the EOT car 26 must be near the POI 28. Therefore, based on the fact that the RFID tag reader 32 has read data from the RFID tag 30, it can be inferred that the EOT 26 has passed the POI 28.

c) In another embodiment, with reference to FIG. 6, a method 100 of determining when the EOT car 26 clears the trackside POI 28 is illustrated. The method 100 includes reading 102 the RFID tag 30 using the RFID tag reader 32 of the EOT car 26. Data read from the RFID tag 30 is then transmitted 104 to the HOT car 24. The HOT train management system 40 then compares 106 location coordinates read from the RFID tag 30, or derived from the data read from the RFID tag 30, with expected location coordinates corresponding to where the HOT train management system 40 expects the EOT car 26 to be located. If the read location coordinates correspond to the expected location coordinates, the HOT train management system 40 validates 108 that the EOT car 26 has cleared the POI 28. In addition, the HOT train management system 40 validates 110 the integrity of the train 20 since the EOT car 26 is at the expected location. If the read location coordinates do not correspond to the expected location coordinates, the HOT train management system 40 can indicate that the EOT car 26 may not have cleared the POI 28 and/or that the integrity of the train has been compromised, i.e. one or more cars including the EOT car 26 may have separated from the train 20 since the EOT car 26 is not at the expected location.

d) Rate of travel between two POIs. Data can be read from an RFID tag 30 at a first POI 28, and data can be read from an RFID tag 30 at a second POI 28 located past the first POI 28. Using the geographical coordinates of each POI 28 to calculate the distance between the first and second POIs 28, or using pre-saved knowledge of the distance between the first and second POIs 28, together with the time between each RFID tag read, the rate of travel of the train 20 between the two POIs 28 can be determined. This rate of travel can be determined using the RFID tag reader 32 on the EOT car 26 or using the RFID tag reader 42 on the HOT car 24.

e) Confirm train integrity. In addition to confirming train integrity in the manner discussed above in FIG. 6, another example of a method 120 of confirming train integrity is illustrated in FIG. 7. In the method 120, data from the RFID tag 30 on a POI 28 is read 122 by the RFID tag reader 42 on the HOT car 24 as the HOT car 24 passes the POI 28. Thereafter, data from the RFID tag 30 on the same POI 28 is read 124 by the RFID tag reader 32 on the EOT car 26 as the EOT car 26 passes the POI 28. Data read by the RFID tag reader 32 is then transmitted 126 from the EOT car 26 to the HOT car 24. The HOT train management system 40 then determines 128 whether or not the tag read by the RFID tag reader 32 of the EOT car 26 occurred at or near the expected time which can be calculated based on the rate of travel of the train 20 and the length of the train 20 both of which are known. If the determination at 128 is yes, then the train integrity is confirmed 130. If the determination at 128 is no, that can indicate a possible train integrity problem 132, i.e. one or more cars including the EOT car 26 may have separated from the train 20 since the EOT car 26 did not perform its read of the RFID tag 30 at the expected time.

The RFID system, including the RFID tag 30 and RFID tag reader 32, described herein can also be used to make vital train protection decisions including release authority protection decisions. The term "vital" means that the decision to release authority protection for a train is derived from trusted inputs with known, enumerated, and mitigated failure modes, or the decision to release authority protection is derived from the fusion of diverse sensor inputs whose failure modes do not overlap and can be shown to not produce an unsafe decision if combinations of them occur. The language "train protection decisions" refers to the decision of whether or not to release authority protection behind a train based on whether one is sure (with enough safety or certainty) that the train has passed out of a given physical/virtual block location. Currently, this type of release authority decision is made by signaling systems through the use of track circuits. However, using the RFID system described herein, with the fusion of the various EOT device 50 sensor inputs discussed above including the detection of the RFID tags 30, an onboard positive train control computer located in the HOT car 24 can make a similar sort of decision, or can provide a vital indication to a remote location, such as a dispatch center, to make the decision.

When used for making vital train protection decisions including release authority protection decisions, the RFID system described herein is set-up so that failure modes are fail-safe. For example, a failure mode discussed above is that the RFID tag 30 is not read at the expected time (or not read at all), which can result from a blockage of the RFID tag 30 and/or the RFID tag reader 32, an equipment problem (for example, a faulty RFID tag reader, a faulty, missing or damaged RFID tag, and the like), or an unplanned train separation. In such a fail-safe safety system, the assumption is made that the train 20 has separated until it can be confirmed that the other possibilities (for example defective RFID tag, missing RFID tag, defective RFID tag reader, or signal blockage) have been eliminated by other evidence or by visual inspection.

The RFID technology described herein can be used independently of other techniques for determining EOT car 26 location such as through use of the GPS unit 58 on the end of train device 50 or through use of calculating EOT car position as described in U.S. Pat. No. 8,918,237. In some embodiments, the EOT car 26 determination techniques described herein can be used as a check against these other types of location determination techniques. In addition, as discussed above, the RFID technology discussed above can be used together with other location determination techniques and the other sensor inputs of the EOT device 50 to make vital train protection decisions including release authority protection decisions.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method comprising:

using a radio frequency identification tag reader mounted on an end of train car of a train to read data from a radio frequency identification tag mounted at a trackside point of interest as the end of train car passes the trackside point of interest;

wirelessly transmitting data that is read from the radio frequency identification tag to a head of train car of the train;

receiving the transmitted data at the head of train car;

determining the location of the end of train car at the head of train car based on the received data;

using a radio frequency identification tag reader mounted on the head of train car to read data from the radio frequency identification tag mounted at the trackside point of interest as the head of train car passes the trackside point of interest; and determining if the radio frequency identification tag reader on the end of train car reads data from the radio frequency identification tag mounted at the trackside point of interest at an expected time based on when the radio frequency identification tag reader mounted on the head of train car reads data from the radio frequency identification tag mounted at the trackside point of interest.

2. The method of claim 1, wherein determining the location of the end of train car comprises determining that the end of train car has passed the trackside point of interest.

3. The method of claim 1, wherein determining the location of the end of train car comprises determining a geographical location of the end of train car.

4. The method of claim 1, wherein the data read from the radio frequency identification tag by the radio frequency identification tag reader on the end of train car comprises at least one of geographical coordinates of the trackside point of interest and a unique identifier for the trackside point of interest.

5. The method of claim 4, wherein the data read from the radio frequency identification tag by the radio frequency identification tag reader on the end of train car comprises the geographical coordinates of the trackside point of interest and the unique identifier for the trackside point of interest.

6. The method of claim 4, wherein the data transmitted to the head of train car comprises at least one of the geographical coordinates of the trackside point of interest and the unique identifier for the trackside point of interest.

7. The method of claim 6, wherein the data transmitted to the head of train car comprises the geographical coordinates of the trackside point of interest and the unique identifier for the trackside point of interest.

8. The method of claim 1, wherein determining the location of the end of train car comprises comparing the received data to expected data.

9. The method claim 1, comprising using the determined location of the end of train car to make a vital train protection decision.

10. The method of claim 9, wherein the vital train protection decision comprises making a release authority protection decision.

11. The method of claim 9, wherein a failure of the radio frequency identification tag reader on the end of train car to read data from the radio frequency identification tag or to read data from the radio frequency identification tag at an expected time is treated in a fail-safe manner where an assumption is made that the end of train car has separated from the train.

* * * * *